US009765533B2

(12) United States Patent
Lutes

(10) Patent No.: US 9,765,533 B2
(45) Date of Patent: Sep. 19, 2017

(54) WET SCREED WITH HARDWARE SYSTEM

(71) Applicant: Stego Industries, LLC, San Clemente, CA (US)

(72) Inventor: James Steven Lutes, Sacramento, CA (US)

(73) Assignee: Stego Industries, LLC, San Clemente, CA (US)

( * ) Notice: Subject to any disclaimer, the term of this patent is extended or adjusted under 35 U.S.C. 154(b) by 0 days.

(21) Appl. No.: 14/542,339

(22) Filed: Nov. 14, 2014

(65) Prior Publication Data

US 2016/0138281 A1 May 19, 2016

(51) Int. Cl.

| | |
|---|---|
| ***E04F 21/24*** | (2006.01) |
| ***E04G 21/10*** | (2006.01) |
| ***E04B 1/41*** | (2006.01) |
| ***E01C 23/01*** | (2006.01) |

(52) U.S. Cl.

CPC ..... *E04F 21/241* (2013.01); *E01C 23/01* (2013.01); *E04B 1/4114* (2013.01); *E04G 21/10* (2013.01)

(58) Field of Classification Search

CPC ..... E01C 19/402; E01C 19/006; E01C 19/24; E01C 19/44; E01C 19/405; E01C 19/42; E01C 23/01; E04F 21/02; E04F 21/241; E04F 21/24; E04F 21/20; E04G 21/10; E04B 1/4114

See application file for complete search history.

(56) References Cited

U.S. PATENT DOCUMENTS

| | | | | | |
|---|---|---|---|---|---|
| 1,683,247 | A | * | 9/1928 | Grothe | E04F 21/05 52/678 |
| 2,224,273 | A | * | 12/1940 | Neptune | E04F 21/05 33/293 |
| 2,541,793 | A | * | 2/1951 | Thompson | E04G 25/06 248/354.3 |
| 3,284,973 | A | * | 11/1966 | Ames | E01C 23/01 52/155 |
| 3,579,938 | A | * | 5/1971 | Hanson | E04F 21/05 248/230.2 |
| 3,681,484 | A | * | 8/1972 | McKie | E04G 21/10 249/18 |

(Continued)

FOREIGN PATENT DOCUMENTS

| | | |
|---|---|---|
| DE | 29708625 | 7/1997 |
| JP | 1973896376 | 11/1973 |

(Continued)

OTHER PUBLICATIONS

Office action for U.S. Appl. 14/542,297, dated May 19, 2016, Lutes, "Wet Screed Hardware System", 14 pages.

(Continued)

*Primary Examiner* — James Ference

(74) *Attorney, Agent, or Firm* — Lee & Hayes, PLLC

(57) ABSTRACT

A method including placing a screed hardware unit upright on a surface. The hardware unit includes a base and a post. The base is fastened on the surface such that the post extends vertically from the base. The method further includes adjusting a height of the hardware unit so as to be consistent with a desired grade. Concrete is poured up to and/or around the hardware unit, and the concrete is screeded at the grade indicated by the height of the hardware unit.

11 Claims, 10 Drawing Sheets

(56) References Cited

U.S. PATENT DOCUMENTS 3,964,220 A * 6/1976 Rutkowski ..... E04B 2/7457 52/100
4,158,937 A * 6/1979 Henry ..... E04F 21/24 52/365
4,371,330 A * 2/1983 Heffernan ..... E04G 21/10 280/28.17
4,663,796 A * 5/1987 Helling ..... B25G 3/20 15/144.2
4,740,348 A * 4/1988 Rose ..... B24B 7/186 264/296
5,173,004 A * 12/1992 Fahrenkrog ..... E04G 21/10 33/1 LE
5,190,401 A * 3/1993 Wilson ..... E01C 19/402 404/118
5,257,764 A * 11/1993 Spaulding ..... E01C 23/01 248/125.1
5,288,166 A * 2/1994 Allen ..... E01C 19/006 404/114
5,468,095 A * 11/1995 Dawson ..... B28B 1/29 404/118
5,540,519 A * 7/1996 Weber ..... E04F 21/24 15/235.4
5,590,494 A 1/1997 Miller
5,800,891 A * 9/1998 Wasitis ..... B32B 3/08 428/194
5,946,871 A 9/1999 Kassardjian et al.
5,956,912 A * 9/1999 Carter ..... E01C 11/106 404/47
6,182,416 B1 * 2/2001 Brackin ..... B28B 7/0017 264/297.9
6,223,495 B1 * 5/2001 Shaw ..... E04B 5/40 264/333
6,413,004 B1 * 7/2002 Lin ..... B25B 7/02 403/171
6,548,164 B1 * 4/2003 Bacon, Jr. ..... C09J 7/0246 359/529
6,709,194 B1 * 3/2004 Grimes ..... E04F 21/05 248/125.1
6,719,486 B2 * 4/2004 Craghan ..... E04F 21/05 33/405
6,854,919 B2 * 2/2005 Neumann ..... B25G 1/04 15/145
6,866,445 B2 * 3/2005 Semler ..... E01C 23/01 404/119
7,086,203 B2 * 8/2006 Owen ..... E01C 23/01 248/354.3
7,152,378 B2 * 12/2006 Takagi ..... B28B 7/0014 249/189
7,562,495 B1 * 7/2009 Fairchild ..... A47K 3/40 4/613
7,610,728 B1 11/2009 Manocchia
7,621,694 B1 * 11/2009 Goodman ..... E01C 19/24 404/119
8,132,774 B1 * 3/2012 Whatcott ..... E01C 19/502 249/34
2002/0157203 A1 * 10/2002 Aguilera ..... E04F 21/24 15/235.4
2002/0192415 A1 * 12/2002 Vogler ..... B42D 5/005 428/40.1
2003/0068200 A1 * 4/2003 Quenzi ..... E01C 19/006 404/114
2004/0071509 A1 * 4/2004 Frankeny, II ..... E01C 19/006 404/118
2004/0168330 A1 * 9/2004 Kim ..... E04G 21/10 33/293
2005/0069385 A1 * 3/2005 Quenzi ..... E01C 19/006 404/114
2005/0163566 A1 * 7/2005 Lindely ..... E01C 19/402 404/114
2005/0207843 A1 * 9/2005 Jackson ..... E04F 21/24 404/118
2005/0218277 A1 * 10/2005 Shaw ..... E04G 13/00 248/201
2006/0107617 A1 * 5/2006 Scott ..... A47G 27/0481 52/750
2006/0192073 A1 * 8/2006 Casale ..... E04G 21/10 249/188
2006/0201092 A1 * 9/2006 Saathoff ..... E04F 13/00 52/385
2007/0144080 A1 * 6/2007 Berner ..... E04D 7/00 52/90.1
2007/0166104 A1 * 7/2007 Face ..... E04F 21/24 404/118
2007/0201302 A1 * 8/2007 Lindley ..... E01C 19/402 366/123
2007/0292208 A1 * 12/2007 Lutz ..... E01C 19/402 404/114
2008/0031689 A1 * 2/2008 Face ..... E01C 19/42 404/118
2008/0202052 A1 * 8/2008 Meier ..... E04C 5/20 52/367
2009/0183451 A1 7/2009 Andreasen et al.
2009/0226257 A1 * 9/2009 Lindley ..... E04F 21/24 404/119
2010/0139196 A1 * 6/2010 Healy ..... E04F 21/05 52/365
2010/0183369 A1 * 7/2010 Lindley ..... E01C 19/402 404/84.5
2010/0221067 A1 * 9/2010 Kahle ..... E01C 19/44 404/75
2010/0226718 A1 * 9/2010 Obergfoll ..... G01C 9/28 404/118
2011/0188930 A1 * 8/2011 Lura ..... E01C 19/22 404/118
2014/0150356 A1 6/2014 Reed
2016/0138280 A1 5/2016 Lutes

FOREIGN PATENT DOCUMENTS

| | | |
|---|---|---|
| JP | 1976049796 | 12/1976 |
| JP | 1984167149 | 11/1984 |
| JP | 1993073157 | 10/1993 |
| JP | 1996003594 | 1/1996 |
| JP | 2004522024 | 7/2004 |
| JP | 2010019411 | 1/2010 |

OTHER PUBLICATIONS

The PCT Search Report and Written Opinion dated Feb. 2, 2016 for PCT application No. PCT/US2015/060447, 9 pages.
Office action for U.S. Appl. No. 14/542,297, dated Dec. 1, 2016, Lutes, "Wet Screed Hardware System", 19 pages.
Office action for U.S. Appl. No. 14/542,297, dated Apr. 6, 2017, Lutes, "Wet Screed Hardware System", 23 pages.

* cited by examiner

WET SCREED WITH HARDWARE SYSTEM

BACKGROUND

When a large area of concrete is poured, it may be desirable to maintain the same grade or elevation across the entirety of the surface. While this might be simply achieved over a small area, large areas are generally more challenging and generally require some form of grade or elevation markers. One approach to maintaining the grade across a large area is to divide the area into smaller strips or bays, into which concrete will be poured individually and adjacent in conjunction with one another while the concrete is wet. The grade is achieved on the first slab and the grade for each subsequently poured strip is based, in part, on the grade of the first slab. This is generally done by an individual who uses a hand float to level out a small portion of the concrete and uses a sight rod or laser level to ensure that it is level before marking that portion as top of slab. This may sometimes be referred to as wet screeding. The remaining concrete in that particular strip is then screeded based on the marked top of slab portion.

Basically, wet screeding is a process of establishing grade or elevation on the surface area of poured concrete. More specifically, wet screeding is the act of striking off freshly placed concrete with a straight edge to a set or desired elevation by means of using adjacent strips, ribbons, or pads of concrete which have already been screeded or floated to the desired elevation, and while the adjacent concrete is still in a plastic state. As the straight edge is pulled across the top of the concrete, excess concrete is pulled out of the way to make a level surface, and places that are too low have concrete added to them until the grade is uniform. Once a bay or strip of the concrete slab is screeded, the adjacent bay or strip is poured and the grade for the newly poured concrete is based, in part, on the previously completed bay or strip.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
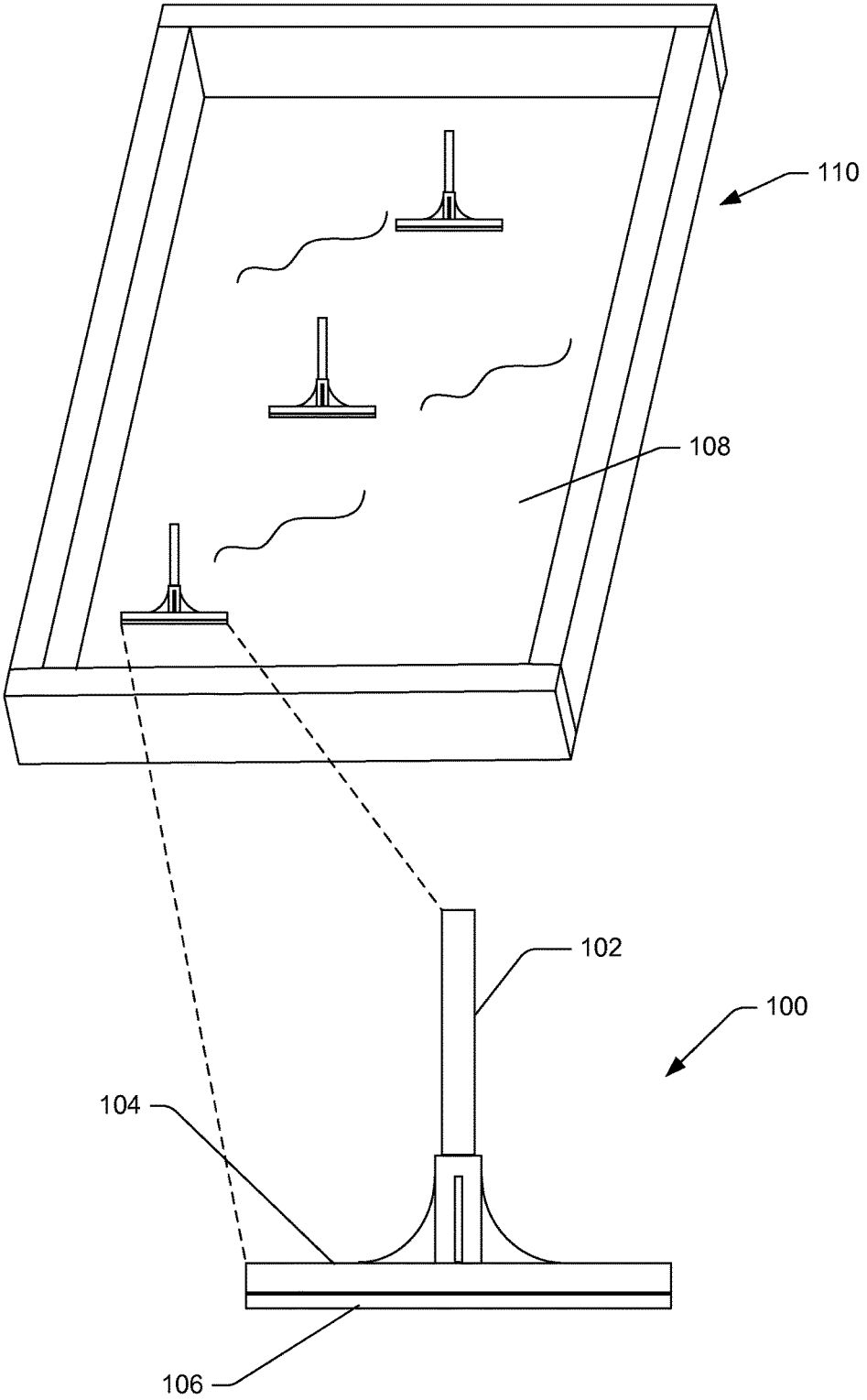
FIG. 1 illustrates an isometric view of a strip or bay for concrete with an example screed hardware apparatus, which is projected larger for clarity.

This disclosure is directed to a hardware system/unit for use in screeding concrete. When a large area of concrete is constructed, it may be desirable to maintain the same grade or elevation across the entirety of the surface. Generally, the large area is divided into smaller strips or bays, which will be poured individually and adjacent in conjunction with one another when the concrete is wet. Sometimes a membrane, such as a vapor barrier for example, may be placed on the subgrade before pouring the concrete in order to prevent moisture from passing through the concrete into the floor sub-structure and causing damage. As such, punctures in the membrane are undesirable as punctures may actually violate industry installation standards if not sealed thereafter.

Due to the nature of wet concrete being somewhat fluid prior to hardening, it may be a challenge to ensure an accurate grade or elevation in the strip. In an embodiment according to features described herein, a screed hardware system may be used to assist an individual in maintaining a desired grade or elevation, while simultaneously maintaining the integrity of any membrane that may be used. Specifically, an individual may place one or more units of the hardware system described herein on the surface where the concrete will be poured, for example, on a membrane, if such is used. The height of the unit(s) may be adjusted if necessary to establish the appropriate grade or elevation. The concrete may be poured while the hardware units are in place and the person pouring the concrete may be able to better determine how much concrete to pour by comparing the height of the concrete to the height of the hardware unit(s). The hardware unit(s) or a portion thereof may be retrieved from the strip as the concrete is screeded at the height of the hardware unit(s).

In a specific example, the hardware unit(s) may include a peel-and-stick base portion. When a unit is to be placed on a surface, the user may peel a sheet from the base portion, thereby exposing adhesive, and the unit may be set down with the adhesive facing the surface. The unit may then stick to the surface and support a grade marker in an upright position so that the concrete may be easily poured and screeded to the level of the grade marker without concern that the grade marker will fall.

Accordingly, the screed hardware system described herein may accurately and effectively assist a user in quickly pouring and screeding concrete. In the following paragraphs various embodiments of a screed hardware system including a base, an adhesive member, a post, and a cap are described.

It is noted that suitable materials for producing any of the base, the post, and the cap may include, but are not limited to: metal (e.g., steel, aluminum, etc.), plastic, cardboard, ceramic, glass, natural materials such as wood, synthetic materials, or any combination thereof. For example, a portion of the base may be made of cardboard while another portion of the base may include plastic. Further, the materials of the individual parts may differ from the material of the other parts. For example, the base may be plastic, while the post may be steel. Moreover, potential materials for the adhesive of the instant application may include, but are not limited to: acrylics, such as a pressure sensitive acrylic; butyl or resinous, rubber based synthetics; and epoxy.

FIG. 1 illustrates an example strip 110 (or bay) in which concrete may be poured to create a slab. As depicted, a plurality of hardware units representative of an embodiment of screed hardware 100 that may be used in the screeding process are disposed in the strip 110. Furthermore, as an exemplary embodiment, the screed hardware 100 is depicted in use as adhered to a membrane 108 placed on the bottom surface of the strip 110, over which the concrete may be poured. It is noted that the membrane 108 may be a membrane of any type or quality of material. For example, the membrane 108 may be a high quality vapor barrier upon which the screed hardware 100 may be secured. The screed hardware 100 may include a post 102, a base 104, and an adhesive member 106. In the screeding process, the adhesive member 106 may be placed between the base 104 and the membrane 108 in order to affix the base 104 to the membrane 108 without piercing the membrane 108, whereby the base 104 and post 102 are secured relative to the membrane 108 in an upright position.

As indicated by the arrows pointing in opposite directions in FIG. 1, the post 102 may be removably insertable into the base 104. Other elements of post 102 will be further described according to the depictions of the post 102 in FIGS. 2A-2G. The elements of the base 104 are described herein according to the depictions in FIGS. 3A and 3B. Elements of the adhesive member 106 are discussed with respect to FIGS. 4A-4C. While FIG. 1 does not show a cap on the post 102, caps are described with respect to FIGS. 5A-6C.

Illustrative Embodiments of a Post

Figure 2D:
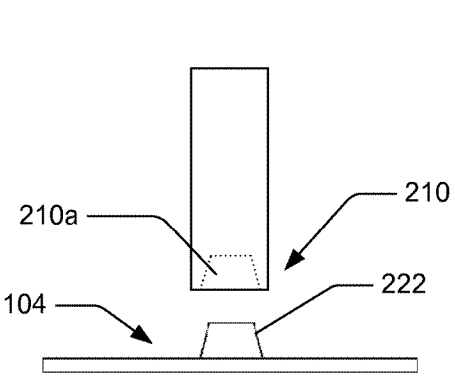
FIG. 2D illustrates an alternative example end of a post of a screed hardware apparatus.
Figure 2C:
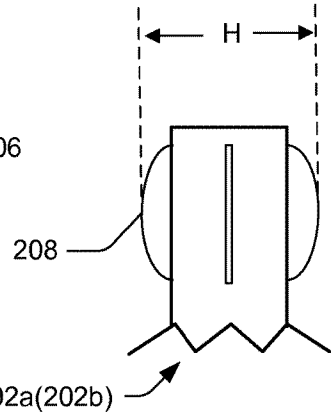
FIG. 2C illustrates another example end of a post of a screed hardware apparatus.
Figure 2B:
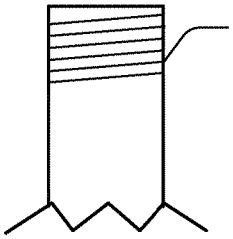
FIG. 2B illustrates an example end of a post of a screed hardware apparatus.
Figure 2A:
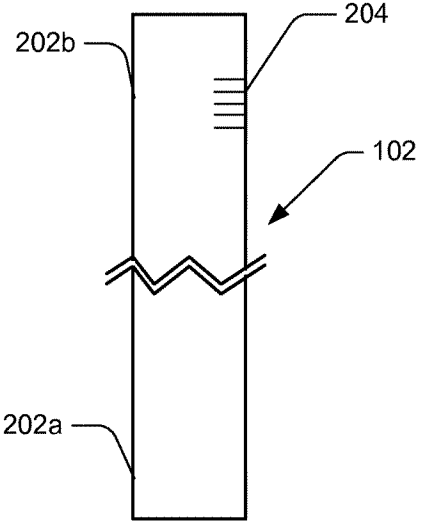
FIG. 2A illustrates an example of a post of a screed hardware apparatus.

Specifically, FIG. 2A depicts post 102 having a base end 202*a* and a distal end 202*b*. The base end 202*a* may be inserted into a base (such as base 104 in FIG. 1), however, it is contemplated that either the base end 202*a* or the distal end 202*b* may be interchangeably inserted into the base. Alternatively, each of the base end 202*a* and the distal end 202*b* may be configured to connect differently, such that the base end 202*a* may have a first type of connection with a base, and the distal end 202*a* may have a second distinct type of connection with a cap (see, for example, cap 500 in FIG. 5). Some different example types of connections are seen and discussed herein with respect to FIGS. 2B-2E.

The distal end 202*b* of the post 102 may also include visual indicators 204, shown in FIG. 2A, via which the height position of a cap (see, for example, cap 500 in FIG. 5) with respect to the post 102 is determinable. The visual indicators 204 may include, for example, a series of numbered or unnumbered tick marks, colored lines, or numbered lines according to a measurement system. Moreover, the distal end 202*b* of the post 102 itself may simply be painted or colored as a visual indicator of height of the grade.

As discussed above, a user may desire that the grade of the pad is the same at multiple points of the poured concrete pad. In implementing the instant screed hardware 100, a user of the screed hardware 100 may rely upon the visual indicators 204 on the post 102 when placing a cap on the post 102 to determine the height of the cap and thereby help facilitate a uniform grade throughout the pad being screeded.

Alternatively, in some situations, a post, such as post 102, may be used alone without a cap to measure the height of the grade. In this circumstance, the distal end 202*b* of the post 102 itself may functionally act as the grade marker "cap," which is discussed further herein, whether painted, otherwise marked, or left unmarked in its manufactured state, and used as a visual indicator of height. Thus, for the purposes of this application and the claims herewith, the terms "cap" and "cap member" may each refer to either an additional component that is attachable to the post or the "cap" end, i.e., the distal end, of the post itself. However, for the sake of clarity, when discussing a cap that is not part of the post itself, the specification may specify that the cap is attachable to the post, such as with respect to those discussed with respect to FIGS. 5A-7. Furthermore, it is contemplated that the terms "cap" or "cap member" may also refer to a component that does not directly cover or "cap" the distal end of the post, but rather the terms may include a component that is secured around or near the distal end of the post, such as the clamp attachment 700 described with respect to FIG. 7 herein below.

FIG. 2A shows that both the base end 202*a* and the distal end 202*b* may be generally cylindrical, having no threads or other components thereon. Such a base end 202*a* and distal end 202*b* may be connected to respective elements, such as a base or a cap, via an interference press fit as described below.

For the purposes of this application, an interference press fit is defined as follows. Generally, an interference press fit occurs when an extension or protrusion of a first element of a device is pressed into an opening in a second element of the device, and where the opening is correspondingly shaped to accommodate the extension or protrusion, yet the opening is dimensioned smaller than the external dimensions of the first element, such that there exists "interference" between the exterior walls of the extension or protrusion and the interior walls of the opening. As a consequence of the interference, increased friction may exist between the first and second elements. Thus, when connecting the first element and the second element, additional force may be needed to press fit the first element into the second element to overcome the increased friction caused by the interference.

Accordingly, in the instant application, the friction from interference, between the base end 202*a* and/or the distal end 202*b* of post 102 in FIG. 1 and an opening in a base and/or an opening in a cap, may be helpful in securing the post or cap to the base or post, respectively. It is noted that this interference press fit may be alternately, or similarly expressed as a telescopic structure, whereby one or more sections of a post telescopically extend and maintain the extended position via frictional interference.

In the following discussion of FIGS. 2B-2E, it is to be understood that, even when only one end of a post is depicted (see FIGS. 2B and 2C) or the connection between just a base and the base end of a post is depicted (see FIGS. 2D and 2E), it is contemplated that the same features may be implemented on both ends of the post and/or a connection between a cap and the distal end of a post just as easily. Therefore, for convenience and simplicity of the following discussion regarding FIGS. 2B and 2C, the use of the term "post end 202*a*(202*b*)" may refer equally to either the base end 202*a* and/or the distal end 202*b*. FIGS. 2B and 2C are also each labeled with reference numbers "202*a*(202*b*)" for consistency.

Thus, FIG. 2B depicts a post end 202*a*(202*b*) having an exterior threaded surface 206. In use, the threaded surface 206 of the post end 202*a*(202*b*) may connect via rotation with a corresponding interior threaded surface of a cap or base (not shown in FIG. 2B). Moreover, the threaded surfaces might be disposed on opposite surfaces than what is stated above. Meaning, instead of the post having the threaded surface on the outside surface, threads could be created on an internal surface, which surface would engage with an exterior threaded surface on the cap or base.

In an alternative embodiment of a connection means between a post and a base or cap, FIG. 2C illustrates post end 202*a*(202*b*) as having protrusions 208 that extend from an external surface of the post 102 in a radial direction. The protrusions 208 may be symmetrical about an axis of the post 102 or the protrusions 208 may be randomly placed. Further, while more than one protrusion 208 is shown in FIG. 2C, there may only be a single protrusion 208. The protrusions 208 are sized such that a length of extension H from a first point at an outermost edge of a protrusion 208 to a second point, which the farthest point of extension of the post 102 or another protrusion 208 on an opposite side of the first point is larger than an interior diameter of the corresponding opening of a base or cap into which the post 102 is inserted. In this manner, the post end 202*a*(202*b*) of FIG. 2C may be forcefully inserted into a cap or base in a press fit manner. Like the interference press fit described above with respect to FIG. 2A, the embodiment of FIG. 2C involves interference, however, the interference is between the inner surface of a cap or base and the protrusions 208 instead of an exterior wall of the post 102. The protrusions 208 may be made of a material less rigid than the material of the base or cap into which the post 102 is inserted, and may have elastic properties, so as to flex inwardly, possibly even against the sides of the post 102 upon insertion into a base or cap.

Figure 2G:
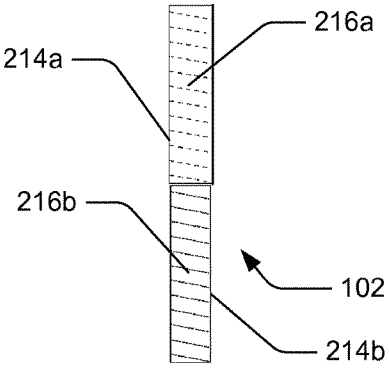
FIG. 2G illustrates an alternative embodiment of a variable-sized post of a screed hardware apparatus.
Figure 2F:
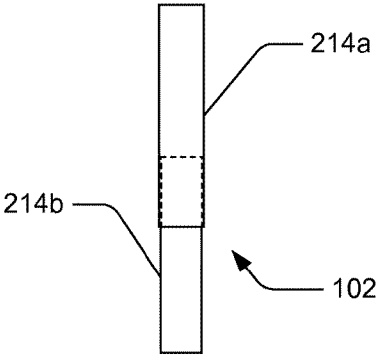
FIG. 2F illustrates an embodiment of a variable-sized post of a screed hardware apparatus.
Figure 2E:
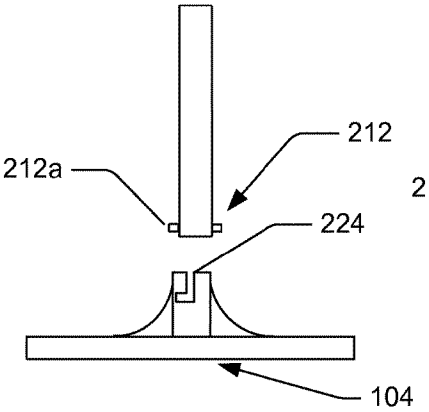
FIG. 2E illustrates another alternative example end of a post of a screed hardware apparatus.

Additional alternative embodiments of connecting the post to the cap or base are shown in FIGS. 2D and 2E, however, due to the unique structure of the corresponding attachment of either a base or a cap, a base 104 is depicted in each figure, as an example.

Specifically, FIG. 2D shows a form and counter-form connection 210 between base 104 and base end 202*a*. The connection 210 may include a shaped cavity 210*a* within the base end 202*a* and a correspondingly shaped base insertion member 222 on the base 104 for insertion into the cavity 210*a*. The specific shape of the cavity 210*a* and the insertion member 222 may not be as important as the underlying concept of using a form and counter-form. That is, any shape that can be accommodated in the base end 202*a*, which permits insertion of a counter-shaped insertion member 222, and which provides some stability to maintaining the post 102 upright when in use, may facilitate the connection 210.

Another alternative embodiment of connecting a cap or base to a post, is depicted in FIG. 2E. FIG. 2E shows a connection 212 between base end 202*a* and base 104. Base end 202*a* may include one or more key protrusions 212*a* extending from an external surface of the post 102 in a direction transverse to the axis of the post 102. The width of the key protrusions 212*a* may correspond to the width of a key slot 224 on the sides of an opening in the base 104, with which the key protrusions 212*a* engage to remain connected. While the key slot 224 might simply extend in a straight line, different portions of the key slot 224 may extend in different directions so as to prevent accidental removal of the post 102. For example, the key slot 224 may be an L-shape as seen in FIG. 2E. In such a case, in order to insert a post having key protrusions 212*a*, the key protrusions 212*a* on the base end 202*a* and an entrance to the key slot 224 on the base 104 are placed in alignment. The base end 202*a* may then be inserted into the base 104 so that the key protrusions 212*a* enter the key slot 224 up to a stopping point. The post may then be rotated axially to engage the key protrusions 212*a* within a transverse portion of the key slot 224 so that the key protrusions 212*a* are confined in a direction of insertion. Removal of the post may be simply achieved by reversing the above steps. Namely, axially rotating the post in an opposite direction until the key protrusions 212*a* are no longer confined within the transverse portion of the key slot 224, and then extracting the post through the entrance to the key slot 224.

The above example embodiments described with respect to FIGS. 2A-2E are merely some of the many ways in which the post can be connected to a base and/or a cap. The embodiments of FIGS. 2A-2C may also further provide the user with the ability to adjust a height of the cap with respect to the base and the post. As an alternative to adjusting the height of the cap using any of the various embodiments of connections at the ends of the post, it is contemplated that the length of the post itself may be adjustable as well. Examples of posts with an adjustable length follow with the description of FIGS. 2F and 2G.

In some embodiments of a post having an adjustable length, the post 102 may include a first part 214*a* and a second part 214*b*, as depicted in FIGS. 2F and 2G. In FIG. 2F, the first and second parts 214*a*, 214*b* are simply put together via a tight interference press fit. That is, the first part 214*a* has an outer diameter slightly larger than the inner diameter of the second part 214*b*. As such, to assemble the post 102 to a desired length, the first part 214*a* is forcefully inserted into the second part 214*b* until the desired length is achieved. In FIG. 2G, first and second parts 214*a*, 214*b* of post 102 are put together to a desired length. However, instead of a post with a press fit as in FIG. 2F, FIG. 2G depicts corresponding threaded surfaces 216*a*, 216*b* on the adjoining respective surfaces of first and second parts 214*a*, 214*b* so that the first part 214*a* can be connected to the second part 214*b* via rotational alignment of the threaded surfaces 216*a*, 216*b*. Furthermore, the length of the post 102 can be adjusted in large or small increments depending on the size of the threads that are used in the threaded surfaces 216*a*, 216*b*, as well as the amount of rotation.

Accordingly, there are many post connection embodiments in which the base, post, and cap may be assembled together. Some of the connection embodiments allow for height adjustment. In the embodiments in which a connection between the base and the post does not permit a height adjustment, the distal end of the post or the post itself may allow height adjustment. In other words, it is contemplated that some of the above described embodiments of the connections and components depicted in FIGS. 2A-2G may be combined in multiple ways to achieve a desired height and functionality.

Illustrative Embodiments of a Base

Figure 3B:
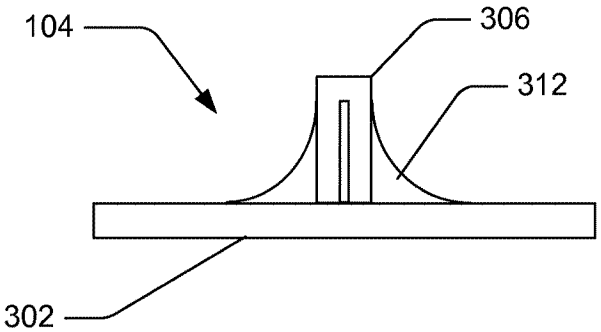
FIG. 3B illustrates a side view of the example base of FIG. 3A.
Figure 3A:
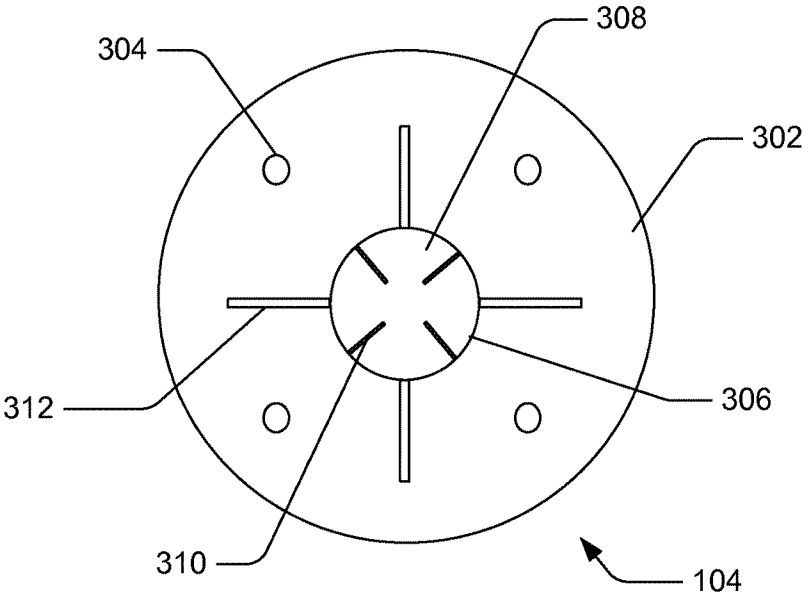
FIG. 3A illustrates a top view of an example base.

FIG. 3A shows a top view of a base 104. The base 104 is used to secure a post in place to a surface, such as a membrane 108 in FIG. 1, so that the post remains in an upright position while in use. The base 104 may include a plate 302, fastener indicators 304, and a post mount portion 306.

In FIGS. 3A and 3B, the plate 302 is depicted as a generally disc-shaped plate being circular and thin, where the width of the plate 302 is greater than the thickness thereof. It is noted, however, that the plate 302 may be of any size or shape sufficient to support a post upright. In some embodiments, the plate 302 is substantially wider than a corresponding width of the post mount portion 306. The plate 302 may have thereon the fastener indicators 304, and the post mount portion 306 may be an integral part of the plate 302 formed during fabrication, or, alternatively, the post mount portion 306 may be a separate unit that is inserted into the plate 302 after each is fabricated. For example, the post mount portion 306 may be a molded plastic unit that is pushed into place in a reinforced cardboard plate 302.

While the base 104 may be used without additional fasteners other than the adhesive member 106 (shown in FIGS. 1 and 4A-4C), it is contemplated that a user may need or want a different or an additional fastener to secure the base 104 to the surface. Thus, the base 104 may include fastener indicators 304 thereon as a visual guide to assist a user in placement of the fasteners. Different types of fasteners, such as nails, screws, staples, etc., may be used to provide additional strength to secure the plate to the underlying surface, should that be acceptable under the circumstances where the concrete pad is being laid. Thus, the fastener indicators 304 may include divots, through holes, printed marks, and a raised surface. In the embodiment of FIG. 3A, the fastener indicators 304 are through holes.

With regard to the post mount portion 306, FIGS. 3A and 3B show the post mount portion 306 as a cylindrical piece having an opening 308 on the side opposite the plate 302. When assembled as part of the screed hardware system 100, a post may be inserted in the opening 308 of the post mount portion 306. Further, the connection between the post and the base 104 may be accomplished by any of the methods and structures described above with respect to FIGS. 2A-2G, or by another method or structure. In an exemplary embodiment shown in FIG. 3A, the post mount portion 306 may include inwardly and radially extending protrusions 310 like the protrusions 208 mentioned with respect to FIG. 2C above. As such, the base end of a post, such as the base end 202*a* shown in FIG. 2A, can be inserted via an interference press fit into the opening 308 of the post mount portion 306, where the interference is created by the internal protrusions abutting the post. FIG. 3B also shows a side view of supports 312, such as a gusset, bracket, brace, etc., that support and strengthen the angle between the wall of the post mount portion 306 and the top surface of the base 104.

Illustrative Embodiments of an Adhesive Member

Adhesives come in many forms that range in density and consistency from solid to liquid. For the purpose of the instant application, a multitude of adhesives may be suitable, particularly, depending on the end use. For example, when the screed hardware system 100 is used in between a base 104 and a membrane 108 (as shown in FIG. 1), an adhesive that is non-corrosive and non-destructive to the material of the membrane may be selected to avoid disrupting the integrity of the membrane and prevent moisture from entering the surface structure. Further, many adhesives begin to harden immediately upon exposure to an open environment. As such, many adhesives are stored or otherwise protected from direct exposure to the environment until right before they are used.

Additionally, it is contemplated that an adhesive, which is compatible with and non-harmful to one element, such as the membrane, might not be compatible with another component, such as the base. Thus, it is contemplated that a suitable adhesive may actually be two or more layers of different adhesives (see FIG. 4B) forming an adhesive composition.

Figure 4A:
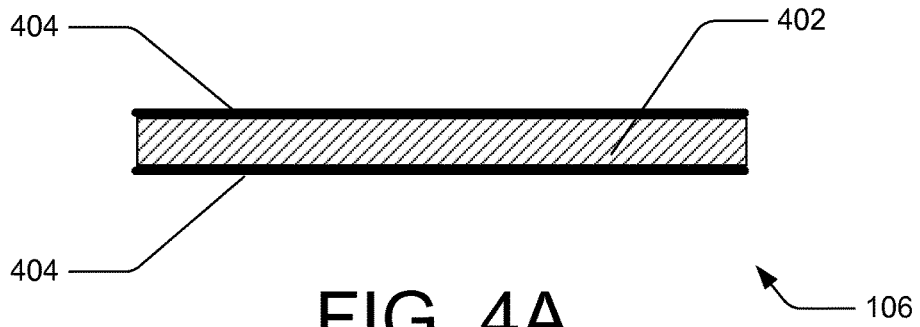
FIG. 4A illustrates a side cross-sectional view of an example adhesive.
Figure 4B:
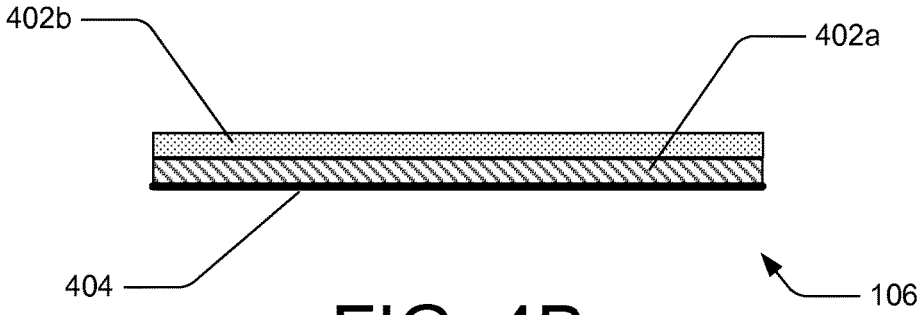
FIG. 4B illustrates a side cross-sectional view of another example adhesive.

In an exemplary embodiment, an adhesive member 106 may include an adhesive 402 having a cover 404 on at least one side of the adhesive to protect the adhesive 402 from exposure prior to use, as shown in FIG. 4A. Note that FIG. 4A depicts a cover 404 on both sides of the adhesive 402, however, the adhesive member 106 might only have one cover 404 and may be adhered to a base prior to reaching a user. Alternatively, as indicated above, a multiple layered adhesive is also contemplated, and as seen in FIG. 4B, the adhesive member 106 may include a first adhesive layer 402*a* and a second adhesive layer 402*b*. Further, the adhesive member 106 in FIG. 4B may have a cover 404 on only one side, as shown.

Figure 4C:
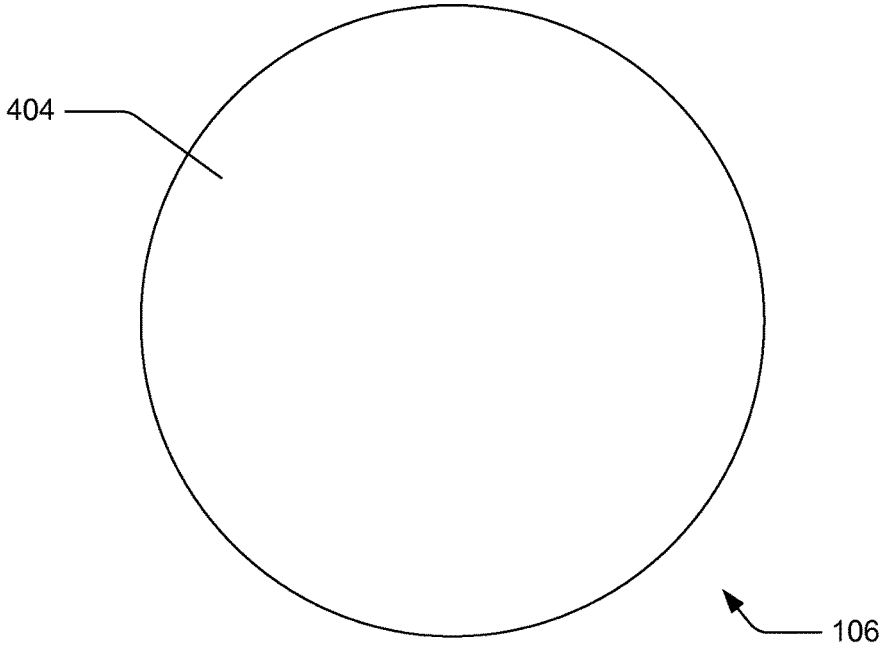
FIG. 4C illustrates a top view of the example adhesive of FIG. 4A.

FIG. 4C depicts a top view of the adhesive member 106, covered with a cover 404, so as to show the corresponding disc-shape of the adhesive member 106. It is noted, however, that adhesive member 106 may be of any shape and size that accommodates the base of the screed hardware system 100 against which it is placed. For example, the adhesive member 106 may be larger than the footprint of the base or even of a different shape, or it may be smaller than the footprint of the base.

Illustrative Embodiments of a Cap

Figure 5B:
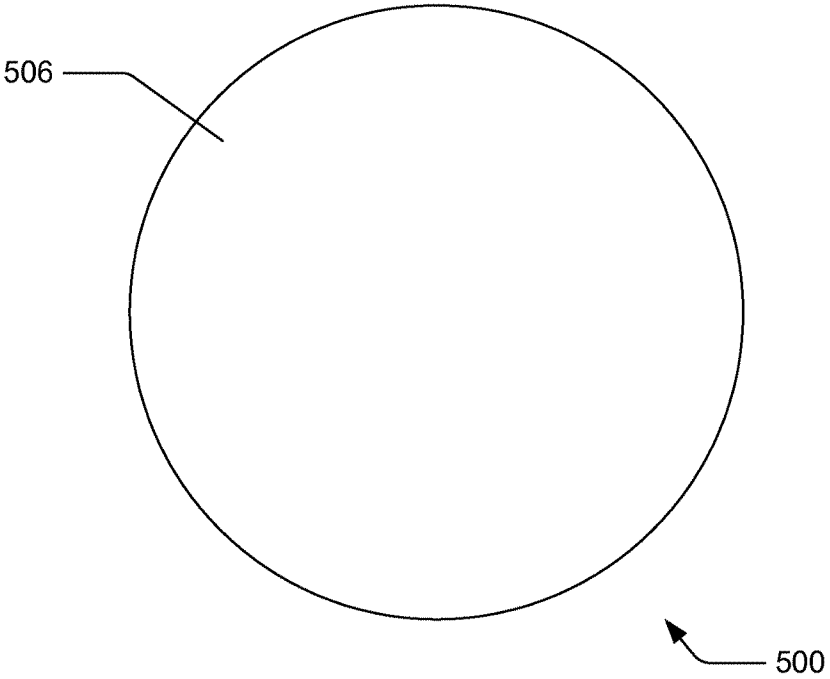
FIG. 5B illustrates a top view of the example grade marker cap of FIG. 5A.
Figure 5A:
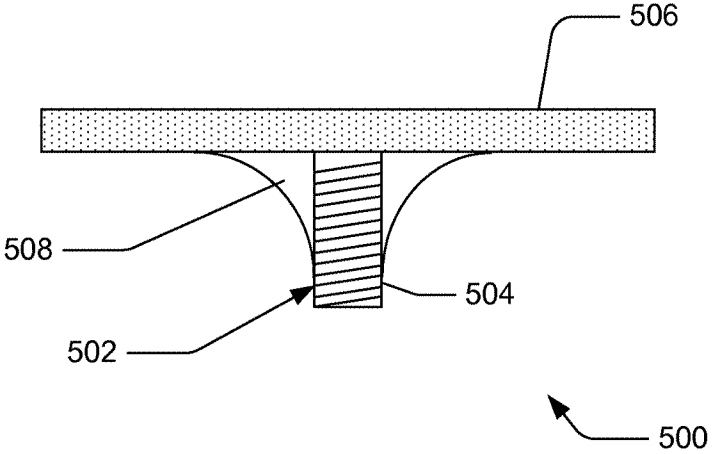
FIG. 5A illustrates a side cross-sectional view of an example grade marker cap.
Figure 6C:
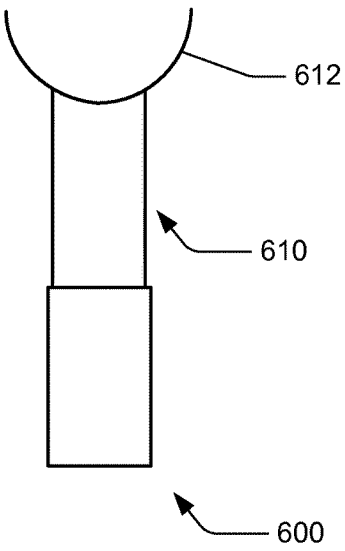
FIG. 6C illustrates a side view of an example embodiment of the cap attachment component of FIG. 6A with a pipe rest cap thereon.

The screed hardware system 100, as described above with respect to FIG. 1, may include the post 102, the base 104, and an adhesive member 106. In addition to the aforementioned components, the screed hardware system 100 may further include a cap 500, as seen in FIGS. 5A and 5B. Some embodiments of the cap 500 may include a grade marker cap (as seen in FIGS. 5A and 5B) and a "saddle" cap, which functions as a pipe rest (as seen in FIG. 6C). An alternative cap 600, which coordinates with a variety of attachments, will be described with respect to FIGS. 6A-6C.

FIG. 5A shows a cross-section of a cap 500 that may include a post mount portion 502 and a grade marker plate 506. In FIGS. 5A and 5B, the grade marker plate 506 is depicted as a generally disc-shaped plate being circular and thin, where the width of the grade marker plate 506 is greater than the thickness thereof. It is noted, however, that the grade marker plate 506 may be of any size or shape so long as the grade marker plate 506 is supportable by the post to which the grade marker plate 506 attaches. In some embodiments, the grade marker plate 506 is substantially wider than a corresponding width of the post mount portion 502 for easier visibility in use. The grade marker plate 506 may be integral with the post mount portion 502 being formed together during fabrication, or, alternatively, the post mount portion 502 may be a separate unit that is inserted into the grade marker plate 506 after each is fabricated.

With regard to the post mount portion 506, FIGS. 5A and 5B show the post mount portion 506 as a cylindrical piece having an opening 503 on the side opposite the grade marker plate 506. When assembled as part of the screed hardware system 100, a post may be inserted in the opening 503 of the post mount portion 502. Further, the connection between the post and the cap 500 may be accomplished by any of the methods and structures described above with respect to FIGS. 2A-2G, or by another method or structure. In an exemplary embodiment shown in FIG. 5A, the post mount portion 502 may include an interior threaded surface 504 which may correspond to, for example, the exterior threaded surface 206 mentioned with respect to FIG. 2B above. As such, the distal end of a post having a threaded surface can be inserted by rotating the threaded surfaces of the post and the cap 504 together. FIG. 5B also shows a side view of supports 508, such as a gusset, bracket, brace, etc., that support and strengthen the angle between the wall of the post mount portion 502 and the bottom surface of the grade marker plate 506.

Figure 6B:
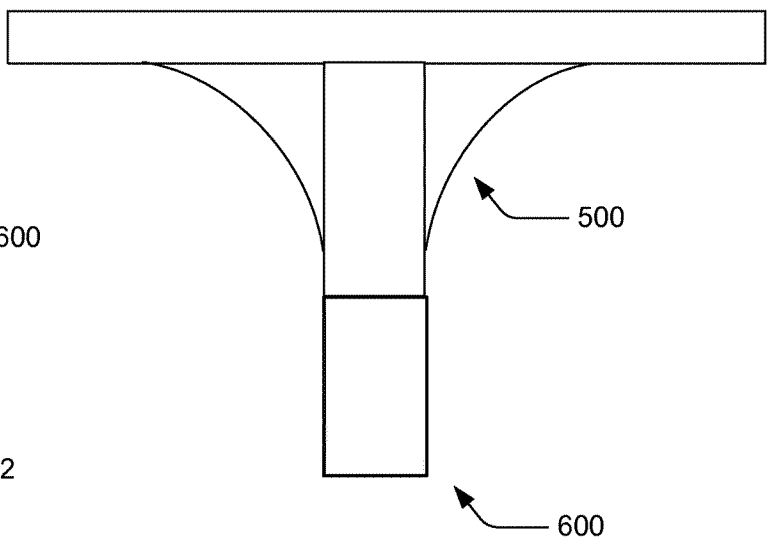
FIG. 6B illustrates a side view of an example embodiment of the cap attachment component of FIG. 6A with a grade marker cap thereon.
Figure 6A:
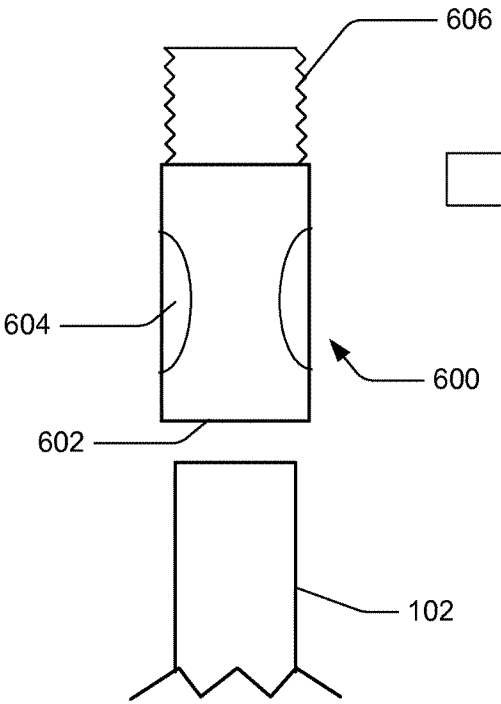
FIG. 6A illustrates a side cross-sectional view of an example embodiment of a cap attachment component.

An alternative embodiment for capping the post in the screed hardware system 100 includes the intermediary cap 600 of FIGS. 6A-6C. While the intermediary cap 600 may be a "cap" on the post 102, the intermediary cap 600 primarily functions as an intermediary component between the post 102 and a cap, such as a grade marker cap 500 (like the cap 500 of FIGS. 5A and 5B) or a pipe rest cap 610. However, the intermediary cap 600 may be press-fitted on the distal end of post 102 via the opening 602 and the intermediary cap 600 may remain in place on the post 102 via radially extending protrusions 604 that extend from an interior wall of the intermediary cap 600, thereby creating friction between the protrusions 604 and the post 102. The protrusions 604 may be like the protrusions 208 of FIG. 2C above.

Additionally, the intermediary cap 600 may include a threaded surface 606 on an end thereof, by which various caps or other attachments may be attached so long as the caps or other attachments have a corresponding threaded surface with which to connect to the threaded surface 606 of the intermediary cap 600. For example, grade marker cap 500 of FIG. 6B or pipe rest cap 610 having a curved pipe rest 612, as seen in FIG. 6C, may attach to the intermediary cap 600 via the threaded surface 606. Subsequently, the caps 500, 610 may be removed for alternate uses.

Illustrative Embodiment of "Cap" Post Attachment

Figure 7:
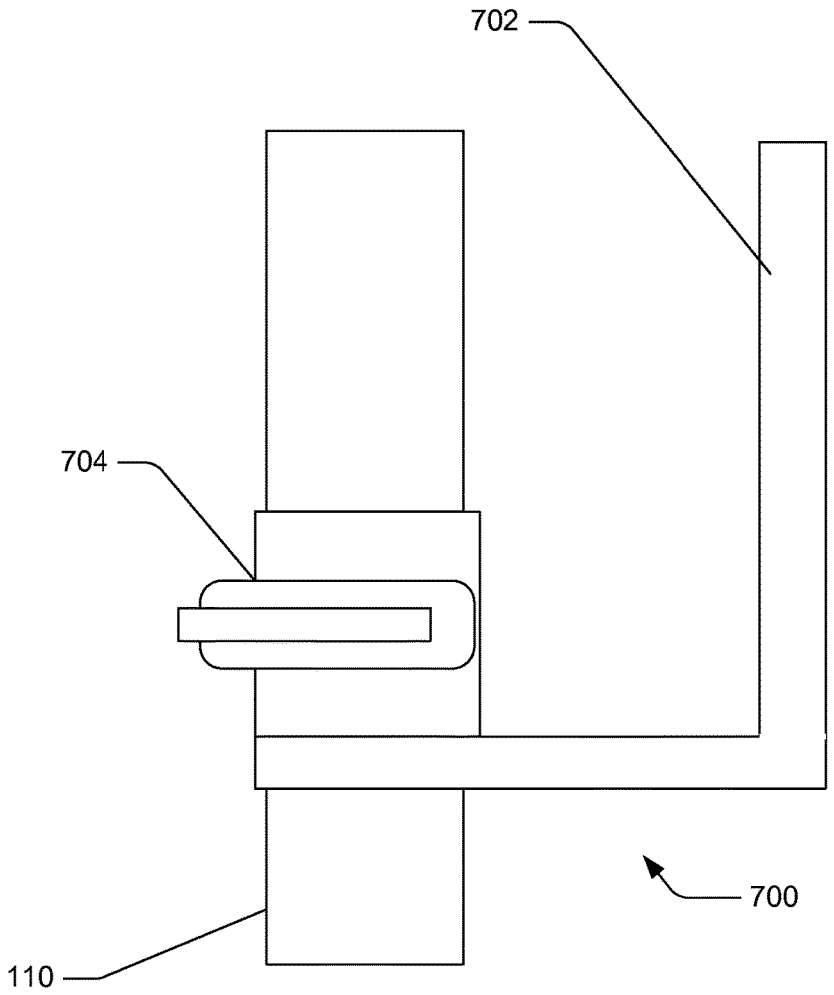
FIG. 7 illustrates a side view of an example clamping bracket attachment.

In addition to the caps described above that may attach to the post 102 of the screed hardware apparatus 100, FIG. 7 depicts yet another "cap" attachment that may be used to assist a user to screed an accurate grade while screeding a concrete pad. Specifically, clamp attachment 700 may include a bracket 702 engaged with a quick-release clamp 704. In some embodiments, the bracket 702 may be L-shaped, as depicted in FIG. 7, and may be sized so as to accommodate a wooden 2×4 beam, on which the concrete might be screeded. The bracket 702 may extend away from the post 110 and then turn upward so as to allow the beam to rest therein between the post 110 and the upward portion of the bracket 702. It is contemplated that the bracket 702 may be shaped in shapes other than the depicted L-shape to accommodate any other item which may be used by a user in the screeding process. The clamp 704 may be similar to modern quick-release bicycle clamps, having a portion that surrounds the post 110 and includes a handle attached to a clamping mechanism. The clamp may function such that when the handle is clasped against the post 110, the bracket 702 and clamp 704 are fixed in place under pressure from the clamp, and when the handle is released away from the post, the clamping mechanism is relaxed so that the clamp 704 and bracket 702 are freely movable along the post 110 for positioning the height of the 2×4 beam for screeding an accurate grade.

Figure 8:
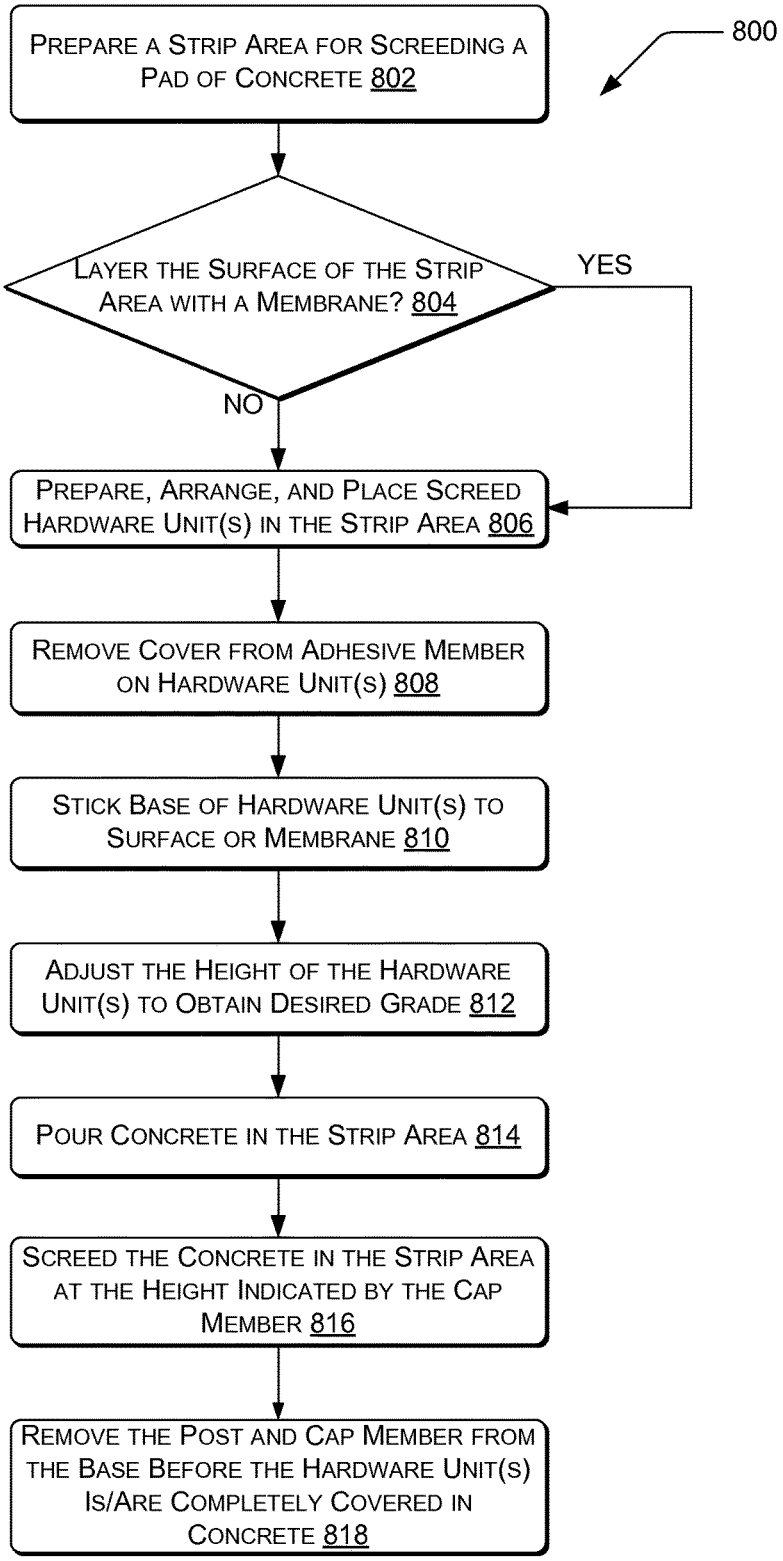
FIG. 8 illustrates an example embodiment of operations of a method of screeding with the screed hardware apparatus.
Figure 9:
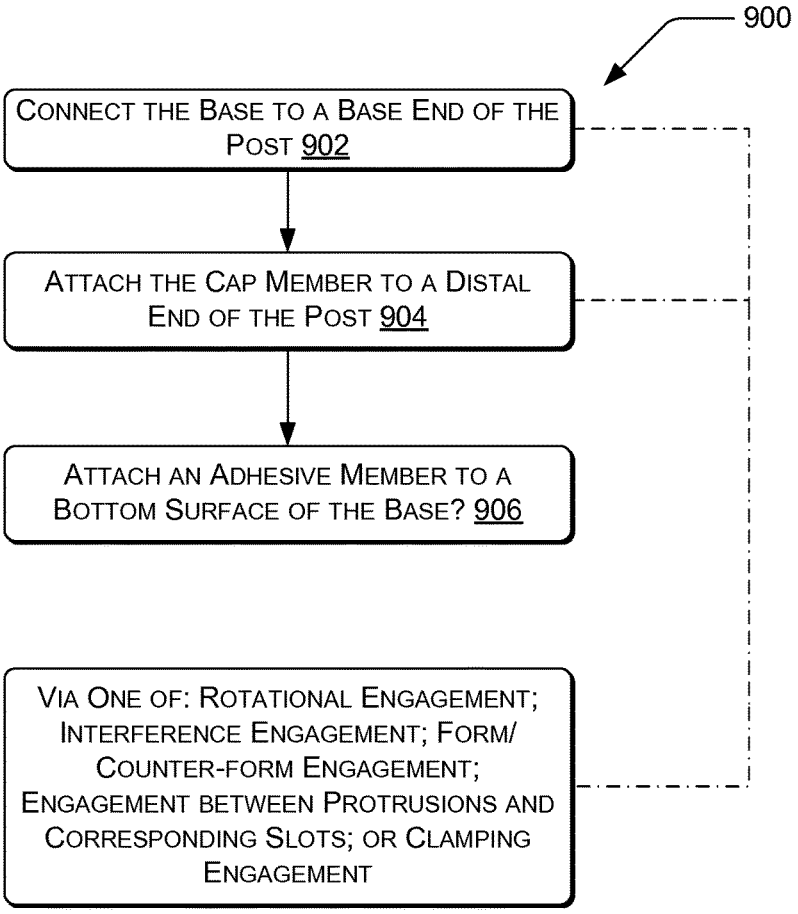
FIG. 9 illustrates an example embodiment of operations of preparing the screed hardware apparatus.
Figure 10:
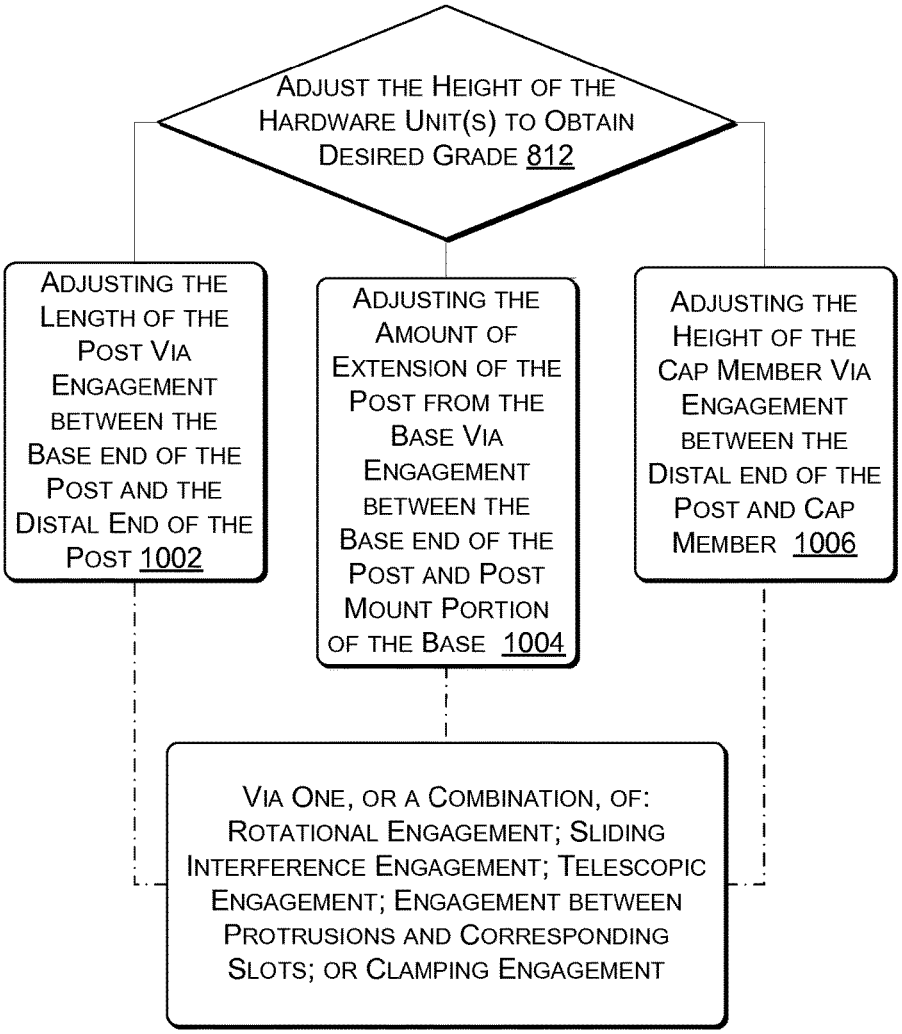
FIG. 10 illustrates an example embodiment of operations of adjusting the height of the screed hardware apparatus.

Illustrative Embodiment of a Method of Screeding with the Screed Hardware Unit The following description of FIGS. 8-10 provides an explanation of how the above-described screed hardware system/unit might be used in the process of wet screeding concrete. Operations described herein are discussed in the order presented only for the purpose of clear explanation, however, in practical application, some of the operations may occur in a different order than the order presented herein. Furthermore, some operations may be omitted or discussed in other parts of the specification for clarity when helpful. As such, it is not intended that the operations described herein be strictly required to occur either entirely, or in the order presented as follows.

In FIG. 8, a method 800 is shown. The method relates to wet screeding concrete with hardware that may correspond to the hardware units described above. In an embodiment, in operation 802, a strip area for screeding a pad of concrete is prepared. Preparation of the strip area may include sectioning off a smaller, more workable sized area that is part of a larger sized area where concrete is desired. In some embodiments, an operation 804 may occur, which is that it may be desirable to layer the surface on which concrete will be poured with a membrane, generally prior to sectioning the strip areas.

Whether a membrane is layered on the surface or not, one or more screed hardware units may be prepared, arranged, and placed in the strip area at operation 806. A further description of what operations are involved in the preparing of the hardware units is described below with respect to FIG. 9. In some instances, it may be desirable to securely fasten the hardware unit(s) to the surface receiving the concrete. Thus, in operation 808, a cover is removed from the adhesive member on base of the hardware unit(s) so as to expose the adhesive. The base may be stuck to the surface or membrane via the adhesive side as stated in operation 810.

In some embodiments, it may further be desirable to obtain a certain grade with the concrete slab to be screeded. In this circumstance, operation 812 may be implemented, wherein the height of the hardware unit(s) may be adjusted. Adjusting the height of the hardware unit may be accomplished in many ways, as described above, and will be further discussed herein below. In operation 814, concrete may be poured into the strip area, and the strip area may begin being screeded at the height indicated by the cap member, as illustrated in operation 816.

During the process of screeding in the strip area, the post and the cap member may be removed from the base before the hardware unit is completely covered in concrete, as indicated in operation 818. As such, the base may remain affixed to the surface of and may be completely covered in concrete.

As stated above with respect to the operation 806, FIG. 9 shows a method 900 of an embodiment of how to prepare the hardware units. It is noted that there may be other steps omitted in the depicted flowchart or other ways to prepare the hardware units to achieve the same purpose. Regardless, FIG. 9 shows an embodiment according to the instant application. In particular, at operation 902, the base may be connected to the base end of the post. Operation 904 indicates that the cap member may be connected to a distal end of the post, and in operation 906, an adhesive member may be attached to a bottom surface of the base. Notably, operation 906 may have occurred prior to a user receiving the hardware unit. For example, operation 906 may have been executed at a facility prior to release of the product. As such, operation 906 may not be performed at the site of screeding concrete. Alternatively, attachment of the adhesive member to the base (operation 906) may be undesirable in some circumstances entirely, where, for example, there is no membrane in place, and/or the user may choose instead to simply secure the base in place using nails or screws with the fastener indicators 304 (shown in FIG. 3A).

With respect to operations 902 and 904, the connections described may be made via one of many ways described above with respect to the hardware system. For example, the base, post, and cap member may be interconnected via one or more of a rotational engagement; an interference engagement; a form/counter-form engagement; an engagement between protrusions and corresponding slots; or by clamping engagement.

As for operation 812, of adjusting the height of the hardware unit, FIG. 10 illustrates some of the ways the height may be adjusted. For example, in an embodiment shown in operation 1002, the height of the hardware unit may be adjusted by adjusting the length of the post. This may be accomplished via engagement between the base end of the post and the distal end of the post. Note that when a length of the post is to be adjusted, the post may consist of two (or more) segments, for example, a base end segment and a distal end segment. As depicted in FIG. 10, adjustment of the length of the post may involve: a rotational engagement, such as via adjacent threaded surfaces; a sliding interference engagement, such as via a press fit between closely sized segments; a telescopic engagement; engagement between protrusions and corresponding slots; or via a clamping engagement.

Alternatively, the embodiment of operation 1004 describes the ability to adjust the height of the hardware unit by an amount of extension of the post from the base via engagement between the base end of the post and post mount portion of the base. That is, a base end of the post may be inserted into the base a variable depths. This may also be accomplished via multiple means, such as a rotational engagement, such as via adjacent threaded surfaces; a sliding interference engagement, such as via a press fit between closely sized post and base mount portions; engagement between protrusions and corresponding slots; or via a clamping engagement.

Likewise, in an embodiment similar to the connection between the base and the post, the height of the hardware unit may also be adjusted by adjusting the height position of the cap with respect to the distal end of the post, as indicated in embodiment 1006. Such an adjustment may be achieved by engagement between the post and the cap in: a rotational engagement, such as via adjacent threaded surfaces; a sliding interference engagement, such as via a press fit between a closely sized post and cap; engagement between protrusions and corresponding slots; or via a clamping engagement.

Conclusion

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A method, comprising:

preparing a screed hardware unit, the hardware unit including a base, a post, and a removably attachable cap member, and the preparing including:

connecting the post to the base via a frictional interference fit by inserting the post into a post mount portion on the base, where a width dimension of the post is greater than a correspondingly shaped width dimension of the post mount portion with which the post engages such that an outer surface of the post encounters frictional force upon insertion, and attaching the cap member to the post via a threaded engagement between a threaded outer surface of the post and a threaded inner surface of the cap member, the cap member being a grade marker cap having an upper surface that is planar across substantially an entirety thereof, the upper surface being a horizontally-oriented surface opposite a side of the cap member on which the post is attachable to the cap member, and the upper surface extending radially outward from a central axis of the cap member which is collinear with an axis of the post when attached;

placing the hardware unit upright on a surface by fastening the base to the surface such that the post extends vertically from the base;

adjusting a height of the hardware unit so that the upper surface of the cap member is consistent with a desired grade;

pouring concrete up to and/or around the hardware unit; and screeding the concrete against the upper surface of the cap member at the desired grade indicated by a height of the upper surface of the cap member on the upright hardware unit, wherein the post has a distal end and a base end, the base end of the post having a smooth continuous surface and being attachable to and detachable from the base at the post mount portion, the post being detachable from the base after the fastening of the base to the surface, and the distal end having the threaded outer surface to connect the cap member directly to the post and via which a position of the cap member is adjustable with respect to the post.

2. The method according to claim 1, wherein the preparing the hardware unit further includes:

peeling a cover off of an adhesive member to adhere the base of the hardware unit to the surface during the placing of the hardware unit.

3. The method according to claim 1, wherein the placing of the hardware unit includes peeling a cover from an adhesive member attached to the base.

4. The method according to claim 1, further comprising laying a membrane on the surface before placing the hardware unit thereon.

5. The method according to claim 1, wherein the placing of the hardware unit includes placing a plurality of hardware units upright on the surface, and arranging the plurality of hardware units so as to maintain the desired grade of the concrete.

6. The method according to claim 1, wherein the placing of the hardware unit includes peeling off a cover covering an adhesive member attached to the base, and sticking the base to a membrane on the surface without piercing the membrane.

7. The method according to claim 1, wherein the adjusting the height of the hardware unit includes adjusting a length of the post.

8. The method according to claim 7, wherein the adjusting the length of the post includes one of rotating the base end of the post with respect to the distal end of the post via a threaded engagement, or sliding the base end of the post with respect to the distal end of the post via an interference press fit engagement.

9. The method according to claim 1, wherein the adjusting the height of the hardware unit includes adjusting the position of the cap member with respect to the distal end of the post.

10. The method according to claim 9, wherein the adjusting the position of the cap member includes rotating the cap member with respect to the distal end of the post via the threaded engagement.

11. A method, comprising:

preparing a strip area for screeding a pad of concrete;

layering a surface of the strip area with a membrane;

arranging screed hardware units in the strip area, each hardware unit having a base attached to a base end of a post, a removably attachable cap member, and an adhesive member attached to a bottom surface of the base, the arranging including:

connecting the post to the base via a frictional interference fit by inserting the base end of the post into a post mount portion on the base, where a width dimension of the post is greater than a correspondingly shaped width dimension of the post mount portion with which the post engages such that an outer surface of the post encounters frictional force upon insertion, and attaching the cap member to a distal end of the post via a threaded engagement between a threaded outer surface of the post and a threaded inner surface of the cap member, the cap member being a grade marker cap having an upper surface that is planar across substantially an entirety thereof, the upper surface being a horizontally-oriented surface opposite a side of the cap member on which the post is attachable to the cap member, and the upper surface extending radially outward from a central axis of the cap member which is collinear with an axis of the post when attached;

removing a cover from the respective adhesive members so as to expose an adhesive of the adhesive members;

sticking the exposed adhesive attached to the bottom surface of the base of the hardware units on the membrane without piercing the membrane such that the hardware units are upright having the post extending vertically;

pouring concrete up to and/or around the hardware units in the strip area; and screeding the concrete in the strip area against the upper surface of the cap member at a desired grade indicated by a height of the upper surface of the cap member on the upright hardware units, wherein the post has a distal end and a base end, the base end of the post having a smooth continuous surface and being attachable to and detachable from the base at the post mount portion, the post being detachable from the base after the fastening of the base to the surface, and the distal end having the threaded outer surface to connect the cap member directly to the post and via which a position of the cap member is adjustable with respect to the post.

* * * * *